US008047133B2

(12) United States Patent
Herbert

(10) Patent No.: US 8,047,133 B2
(45) Date of Patent: Nov. 1, 2011

(54) CUT-OFF REGISTER CONTROLLER IN A FORMER ASSEMBLY AND METHOD OF CONTROLLING CUT-OFF REGISTER

(75) Inventor: Burkard Otto Herbert, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 56 days.

(21) Appl. No.: 12/451,980

(22) PCT Filed: Jun. 17, 2008

(86) PCT No.: PCT/EP2008/057604

§ 371 (c)(1),
(2), (4) Date: Oct. 10, 2009

(87) PCT Pub. No.: WO2009/024371

PCT Pub. Date: Feb. 26, 2009

(65) Prior Publication Data

US 2010/0132572 A1 Jun. 3, 2010

(30) Foreign Application Priority Data

Aug. 21, 2007 (DE) ..... 10 2007 039 372

(51) Int. Cl.
*B41F 13/56* (2006.01)

(52) U.S. Cl. ..... 101/227; 101/226

(58) Field of Classification Search ..... 101/227, 101/226

See application file for complete search history.

(56) References Cited

U.S. PATENT DOCUMENTS

| | | | | |
|---|---|---|---|---|
| 3,335,928 | A * | 8/1967 | Angell | 226/39 |
| 4,896,605 | A * | 1/1990 | Schroder | 101/486 |
| 5,123,316 | A | 6/1992 | Niedermaier et al. | |
| 5,458,062 | A | 10/1995 | Goldberg et al. | |
| 5,568,767 | A * | 10/1996 | Jackson | 101/226 |
| 5,876,784 | A * | 3/1999 | Hesselmann | 427/8 |
| 6,499,403 | B1 * | 12/2002 | Laulanet | 101/486 |
| 6,526,889 | B2 * | 3/2003 | Tokiwa | 101/485 |
| 6,644,184 | B1 * | 11/2003 | Hajek et al. | 101/177 |
| 6,748,857 | B2 * | 6/2004 | Seiler et al. | 101/226 |
| 6,837,159 | B2 * | 1/2005 | Elkotbi et al. | 101/219 |
| 7,162,954 | B1 | 1/2007 | Helfenstein et al. | |

(Continued)

FOREIGN PATENT DOCUMENTS

DE 3935614 A1 5/1991

(Continued)

*Primary Examiner* — Anthony H. Nguyen

(74) *Attorney, Agent, or Firm* — Jones, Tullar & Cooper, P.C.

(57) ABSTRACT

A cut-off register controller is usable in a longitudinal fold forming assembly of a rotary cylinder printing press that is provided with at least one form folding assembly plane which consists of two adjacently defined longitudinal fold formers. The web ribbon or the partial web ribbons, which are longitudinally formed and folded by the formers are collated at an exit of the former assembly by the operation of a roller pair and are formed into a combined ribbon. That combined ribbon is then fed into a folding apparatus. A number of control circuits are located downstream of the formers and corresponding, in number, to at least the number of formers. The control circuits are usable for controlling the cut-off register of the printed web. Each control circuit has at least one detector and one adjusting member which is usable to adjust the distance between the web or stand and the former.

12 Claims, 9 Drawing Sheets

U.S. PATENT DOCUMENTS

| | | | | |
|---|---|---|---|---|
| 7,523,925 | B2 * | 4/2009 | Herbert et al. | 270/5.02 |
| 7,637,211 | B2 * | 12/2009 | Berberich et al. | 101/485 |
| 2006/0027303 | A1 * | 2/2006 | Hunter | 156/64 |
| 2007/0012211 | A1 | 1/2007 | Berberich et al. | |

FOREIGN PATENT DOCUMENTS

| | | | |
|---|---|---|---|
| DE | 19506774 | A1 | 8/1995 |
| DE | 10307202 | A1 | 9/2004 |
| EP | 1074501 | B1 | 2/2001 |

* cited by examiner

CUT-OFF REGISTER CONTROLLER IN A FORMER ASSEMBLY AND METHOD OF CONTROLLING CUT-OFF REGISTER

CROSS-REFERENCE TO RELATED APPLICATIONS

This application is the U.S. national phase, under 35 U.S.C. 371, of PCT/EP2008/057604, filed Jun. 17, 2008; published as WO 2009/024371 A1 on Feb. 26, 2009 and claiming priority to DE 10 2007 039 372.7, filed Aug. 21, 2007, the disclosures of which are expressly incorporated herein by reference.

FIELD OF THE INVENTION

The present invention is directed to a cut-off register controller in a former assembly and is also directed to a method of controlling cut-off register. At least two fold formers are arranged side by side in a former plane. Folded ribbons or partial ribbons coming from the fold formers are combined at a roller pair at an output of the former assembly to form a combined ribbon which is then fed to a folding unit.

BACKGROUND OF THE INVENTION

A cut-off register controller, for use in controlling ribbons from multiple fold formers, is disclosed in EP 1 074 501 B1. Deviations, which are measured on the ribbon by the use of detectors, are fed, together with measured values for the individual webs, which were recorded upstream of the former, to individual web control elements that are arranged upstream of the former.

DE 39 35 614 A1 discloses a register control device. Each partial web, which has not yet been merged with the ribbon, is assigned its own control loop. The two ribbons to be formed from the partial webs are assigned a control loop which is separate from the former control loops but which is shared by both of the ribbons.

DE 103 07 202 A1 discloses a former assembly having a number n of formers. In an advantageous embodiment, at least n−2 control elements, that influence a ribbon path, are provided.

DE 195 06 774 A1 discloses a printing press in which, for each double-width web, one web path compensating device is provided for the entire web, and one other web path compensating device is provided for a partial web. Both of these devices are situated upstream of the former assembly. Reference marks, which may be applied by magnetizing devices, can be detected by magnetic sensors that are usable for detecting these marks in a ribbon formed downstream of the former assembly. Such reference marks are used to control the web path compensating devices.

SUMMARY OF THE INVENTION

The object of the present invention is to provide a cut-off register controller in a former assembly and to a method of controlling cut-off register.

The object is attained in accordance with the present invention through the provision of a former assembly with a cut-off register controller. At least two fold formers of a web-fed rotary printing press are positioned on a former plane and are arranged side by side. Ribbons and/or partial ribbons, which have been longitudinally formed by the fold formers, are combined over a roller pair, which is located at an output of the former assembly, and are fed to a folding unit. A number of control loops, for use in controlling the cut-off register, are provided after the fold formers. A number of these control loops corresponds, at least, to the number of fold formers. Each control loop has at least one detector and one control element for use to control a path length between the ribbon and the folding unit.

The benefits to be achieved with the present invention consist especially in that the strict requirements with respect to cut-off register, and especially in the case of multi-page products generated from multiple ribbons, can be quickly regulated and/or maintained. This can be accomplished even under non-stationary operating conditions.

Considerable quantities of paper can be saved and thus will not be wasted, especially during start-up of the machine. This can be accomplished, for example, during adjustment to the print-on position and the subsequent run-up to production speed. Even with automatic reel changes, and with the resultant changes in paper properties and/or changes in printing couple parameters that are permitted by such changes, the individual control loops in accordance with the present invention, which control loops are arranged as far downstream as possible, can be rapidly controlled. This system, in accordance with the present invention, involves a substantially shorter reaction path, as compared with prior systems that employ individual web control elements for this purpose. Each control loop is able to perform the control task which has been assigned to it without disruption. In addition, ribbons that may be comprised of partial webs from different webs can be easily controlled.

In advantageous embodiments, in a further improvement of the cut-off register controller in accordance with the present invention, or when viewed separately as a monitoring device, signals from detectors that are arranged on both sides of the same ribbon, and especially ones arranged on the same path segment, can be evaluated with respect to potential ribbon running problems, such as bumps, beads and/or bubbles. In addition, or alternatively, the signals from a detector, which is directed toward the ribbon, can be evaluated for individual web breaks in outer layers. If applicable, appropriate corrective measures can be implemented.

BRIEF DESCRIPTION OF THE DRAWINGS

Preferred embodiments of the present invention are represented in the drawings and will be specified in greater detail in what follows. The drawings show.

DESCRIPTION OF THE PREFERRED EMBODIMENTS

Figure 1:
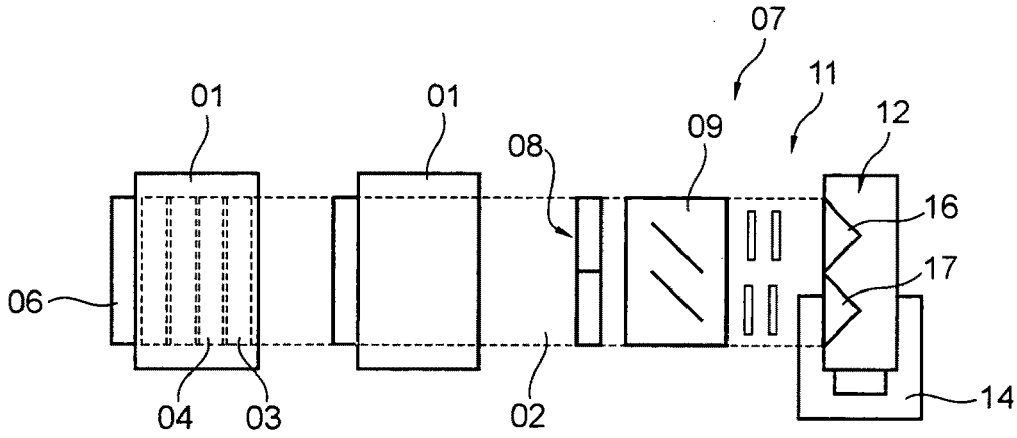
FIG. 1 a schematic top plan representation of a first preferred embodiment of a printing press in accordance with the present invention.
Figure 2:
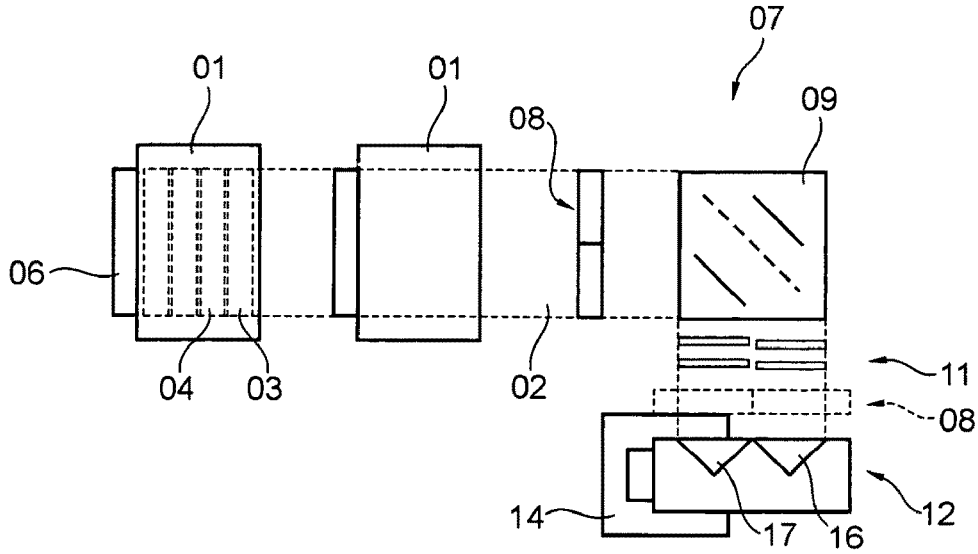
FIG. 2 a schematic top plan representation of a second preferred embodiment of a printing press again in accordance with the present invention.

Referring initially to FIG. 1 and to FIG. 2 there are depicted examples of variations of a printing press which is embodied as a web-fed rotary printing press, and especially printing presses which are embodied as a newspaper printing press, each in a top plan view. The printing press has at least one printing unit 01, that is provided with multiple printing couples, and especially is provided with such printing couples arranged one above the other. A web 02, which is coming from a reel changer 06, is printed on both sides in a multicolor process, for example. Forme cylinders 03 and transfer cylinders 04 of the printing unit 01, which printing unit 01 is configured especially as a printing tower having at least eight print positions and with, for example, four such print positions on each side, have an effective cylinder length which corresponds to at least four, and for example, which corresponds to four or to six, print images of vertical newspaper pages arranged side by side, or to at least four print images of horizontal printed pages, such as, for example, four magazine pages in tabloid format, arranged side by side. During printing, the forme cylinder 04 thus has one or more printing formes on its circumferential surface, for example, with the one or more printing formes being provided with a total of four print images of corresponding printed pages in tabloid or newspaper format, arranged side by side.

Figure 3:
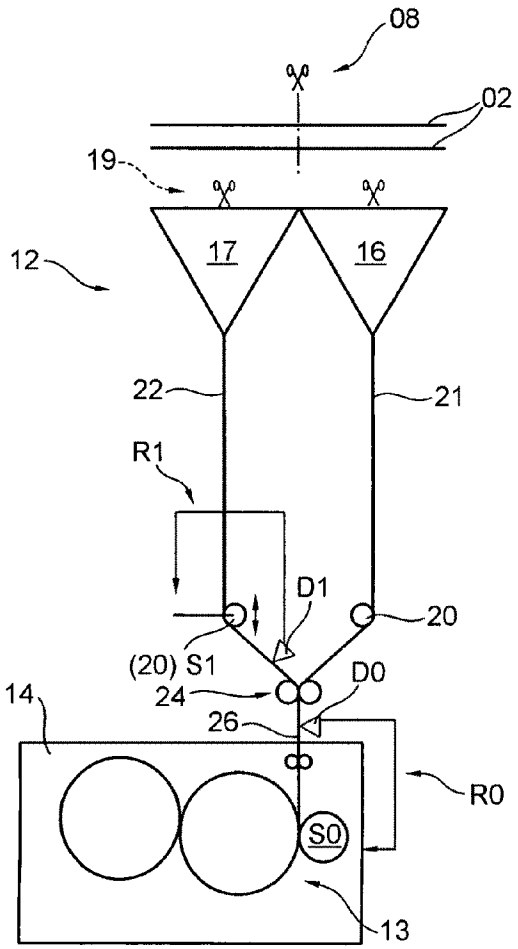
FIG. 3 a side elevation view of a first preferred embodiment of a cut-off register controller in a former assembly.

After it has been printed in the printing unit or units 01, the web 02 passes through a so-called superstructure, which is schematically represented at 07, in which superstructure 07 it is cut lengthwise into partial webs by a longitudinal cutting device 08. The web 02 or partial webs may then be displaced somewhat laterally by the use of optional turning devices 09 and can thus be brought into a different alignment. The partial webs are then aligned, relative to one another, longitudinally via optionally provided register means 11, and are finally folded into ribbons lengthwise in a former assembly 12. These longitudinally folded ribbons are then fed to a cross-cutter 13, for example the cross-cutter of a folding unit 14, as is depicted in FIG. 3.

In FIG. 1 and in FIG. 2, two advantageous embodiments for the configuration of the previously discussed components are represented schematically: In the embodiment of FIG. 1, the former assembly 12 is situated in the machine alignment. Former assembly 12 is thus reached by the webs 02 or by the partial webs through "linear travel," after they leave the printing units 01. If the partial webs are to be turned or displaced laterally or transversely with respect to the machine alignment, at least one longitudinal cutting device 08 is situated upstream of the turning device 09 or the turning devices 09. If none of the partial webs require turning or lateral displacement, the longitudinal cutting device 08 or an optional additional longitudinal cutting device 08 can be arranged directly upstream of the former intake. In the embodiment of FIG. 2, the former assembly 12 is rotated 90° in relation to the machine alignment with respect to its running direction projected into the horizontal plane. The former assembly 12 of FIG. 2 can thus be reached by the web 02 through angled travel of the web 02 over a turning bar of a turning device 09, after leaving the printing units 01. If the partial webs are to be turned, at least one longitudinal cutting device 08 is situated upstream of the turning device 09 or of the turning devices 09. If a turning bar is provided, and has an effective length which, in projection onto the incoming web 02, corresponds to at least the maximum width of a web 02 to be printed, for example to a width of four or of six printed pages in horizontal tabloid or vertical newspaper or broadsheet format, and arranged side by side, the aforementioned longitudinal cutting device 08 or an additional, optional longitudinal cutting device 08 can be arranged directly upstream of the former intake, or in other words can be located to engage the web 02 after turning of the web 02.

In each of the embodiments depicted in FIG. 1 and in FIG. 2, the former assembly 12 has at least one former group, which is provided with multiple fold formers 16; 17; 18, and is especially provided with two or three such fold formers 16; 17; 18, arranged side by side, in the same former plane. The term "in the same plane" in this context means that the formers 16, 17 of this former plane are situated in the same machine plane and/or are at least intersected by the same horizontal plane. In addition to the main line of intersection through the aforementioned longitudinal cutting device 08, additional longitudinal cutting devices 19 may be provided directly upstream of the fold formers 16, 17 or directly downstream of the fold formers 16, 17. These additional longitudinal cutting devices can cut the partial webs apart lengthwise in alignment with the fold spine, in what is referred to as a former center cut that is formed on so-called secondary cutting lines, as seen in FIG. 3. The layers of the partial web, which are placed one on top of the other by the corresponding fold formers 16, 17 then are not folded on both sides. Instead, they lie loosely on top of one another in a single page width. The blades for the main cutting lines from the longitudinal cutting device 08 and those for the secondary cutting lines from the longitudinal cutting device 19 can also be combined structurally to form a shared longitudinal cutting device 08, 19, which can be arranged directly upstream of the former intake.

Figure 14:
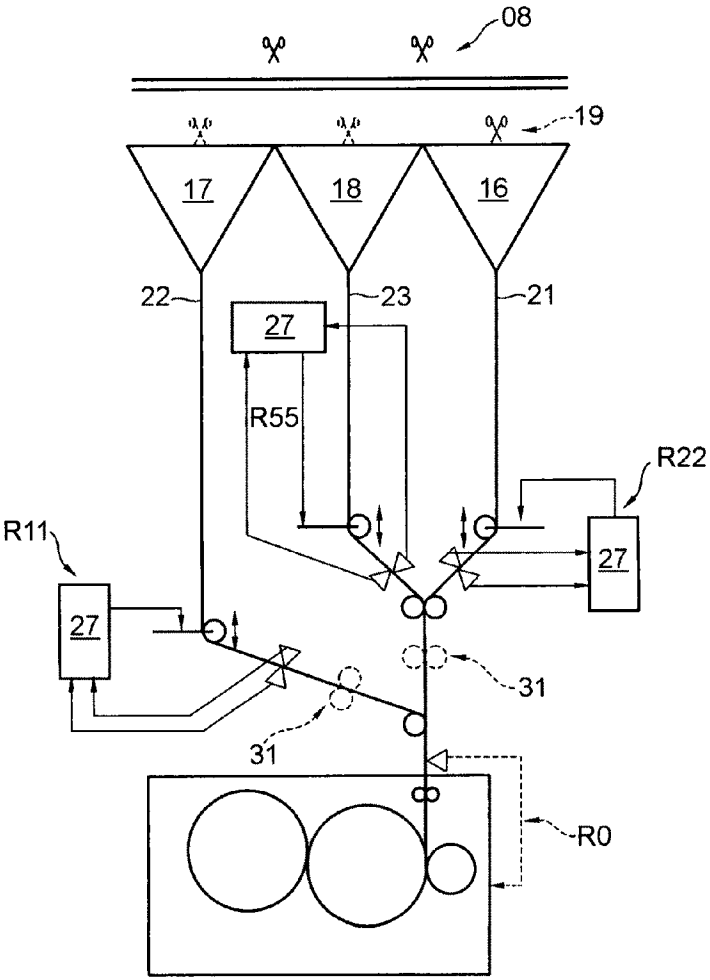
FIG. 14 a side elevation view of a twelfth preferred embodiment of a cut-off register controller in a former assembly with a former plane having three formers.
Figure 13:
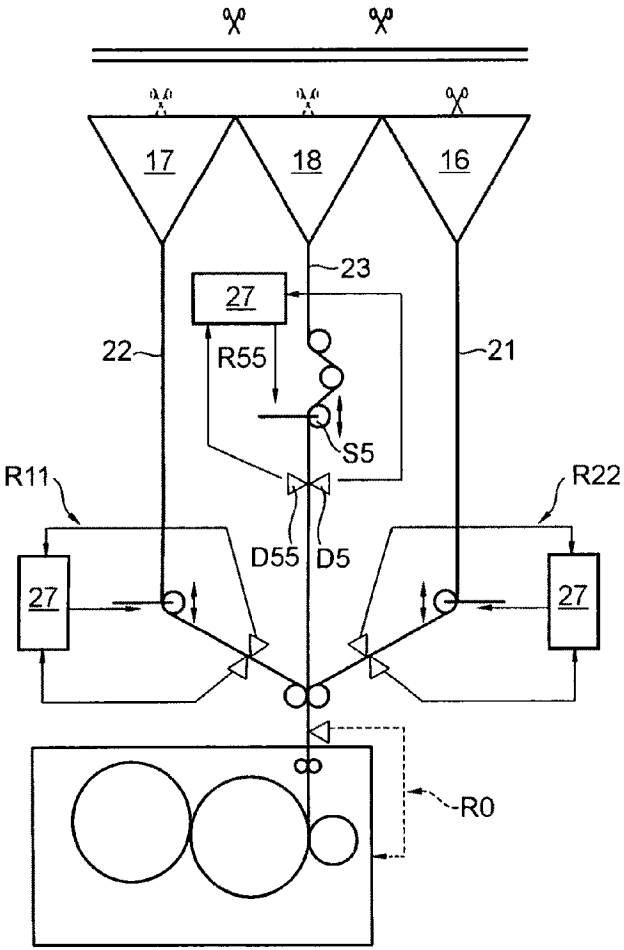
FIG. 13 a side elevation view of an eleventh preferred embodiment of a cut-off register controller in a former assembly with a former plane having three formers.

If, as in the present invention, the printing press has a plurality of fold formers 16; 17; 18 and therefore produces multiple resulting ribbons 21; 22; 23, which will be assembled and cross-cut before or as they enter a further processing stage, as depicted in FIGS. 13, 14, then, because the printed images must be placed one on top of the other, the correct positioning of the ribbons 21; 22; 23, relative to one another in the longitudinal direction is a first decisive criterion for the obtaining of quality in the finished product. Particularly in the situations of varying or of changing operating conditions, such as may occur, for example, during machine start up and/or with a change in material, such as with the use of a different type of paper, and/or a production change, such as varying numbers of partial web layers and/or changing print image, the associated changes in web tension and/or in web elongation can cause the relative longitudinal alignment, and thus also the cut-off registers of the ribbons 21, 22; 23, to change in relation to one another. As a second criterion, former assemblies 12 with multiple ribbons 21; 22; 23, and in which the multiple ribbons necessarily undergo redirections, involve the risk of errors that are associated with turning and with conveyance, such as the shifting of individual outer layers of individual ribbons 21, 22, 23. As a third criterion, even the risk of web breaks in outer layers of individual ribbons 21, 22, 23 affects web shifting and relative longitudinal alignment.

In the following descriptions of preferred embodiments of former assemblies 12 in accordance with the present invention, the three aforementioned problems may be solved separately, in groups, or all together, depending upon the degree of complexity of the problem or problems.

In accordance with the preferred embodiments of the present invention, multiple control loops R0; R1; R2; R3; R1'; R2'; R3*a*; R3*b*; R4*a*; R4*b*; R5; R11; R22; R33; R55, and especially a number of control loops R0; R1; R2; R3; R1'; R2'; R3*a*; R3*b*; R4*a*; R4*b*; R5; R11; R22; R33; R55; which are abbreviated: R0 . . . R55 and that correspond to at least the number of fold formers 16; 17; 18; 16'; 17' of the former assembly 12, and/or a number of control elements S0; S1; S2; S3*a*; S3*b*; S4*a*; S4*b*; S5, abbreviated: S0 . . . S5, that corresponds to at least this number of formers 16; 17; 18; 16'; 17' and/or a number of detectors D0; D1; D2; D3; D1'; D2'; D3; D33; D4*a*; D4*b*; D5; D33; D55; abbreviated: D0 . . . D55; that corresponds to at least this number of formers 16; 17; 18; 16'; 17; are located on the web path downstream of the fold formers 16; 17; 18; 16'; 17', as may be seen schematically in the several figures of drawings.

Preferably, at least a number of control loops R0 . . . R55 which corresponds to the number of formers 16; 17; 18; 16'; 17' each acts on one control element S0 . . . S5 that is independent of other control loops R0 . . . R55. This ensures that the combined ribbon 24 that is ultimately generated by the former assembly 12 will be aligned correctly with the blade which is a part of the folding unit 14, and that the ribbons 21, 22, 23 will be aligned relative to one another without complicated interdependencies. Preferably, the control loops R0 . . . R55 are embodied logically separate from longitudinal register devices 11, which may be provided upstream of the former assembly 12, as depicted schematically in FIG. 1.

The control loops R0 . . . R55, which are relating to the cut-off register, are preferably control loops which function independently of one another in terms of logic, if applicable, including optional signal forwarding in the case of a control element R0 on a ribbon bundle or the combined ribbon 26, as in the preferred embodiments of FIG. 3 or FIG. 7, for example.

It is particularly advantageous for the detector D0 . . . D55 of a ribbon 21, 22, 23 or of a partial ribbon, such as partial ribbons 21.1; 21.2; 21.3; 22.1; 22.2; 22.3, to be arranged in relation to the ribbon path as closely as possible upstream of the point of at which that particular ribbon is combined downstream with one or more other ribbons 21, 22, 23 or other partial ribbons, 21.1; 21.2; 21.3; 22.1; 22.2; 22.3. Preferably, each detector D0 . . . D55 is located between the point of combination, such as, for example, a reel 24 or a reel pair 24 or a crossover roller 28, and the last guide element which is located upstream, such as, for example, a turning roller 20 or a crossover roller 29. In the case of crossed over partial ribbons, 21.1; 21.2; 21.3; 22.1; 22.2; 22.3, the detector D0 . . . D55 can also be arranged downstream of the point of combination on the side that is assigned to the infed partial ribbon, 21.1; 21.2; 21.3; 22.1; 22.2; 22.3, such as may be seen, for example, in FIG. 9 or FIG. 10. In one advantageous embodiment of the present invention, all of the measured values for the ribbons, for example, for ribbons 21, 22 and 23, are picked up by detectors D0 . . . D55, which are arranged on the respectively last partial segment, and upstream of a last point of combination downstream of the former assembly 12.

FIG. 3 through FIG. 11 show embodiments of the present invention with a former plane having two fold formers 16; 17. Webs 02, which are running up to the former assembly 12, are cut lengthwise into partial webs upstream of the former assembly 12, and are guided over the fold formers 16; 17. These are then folded to ribbons 21; 22, or, in the case of the utilization of a former center cut, are placed one on top of the other as partial web strips which are each a single page in width.

As is depicted in FIG. 3, two control loops R0 and R1 are provided downstream of the fold formers 16; 17. In this first embodiment, a detector D1 and a control element S1 are assigned to one of the individual ribbons 21; 22. Another detector D0 and another control element S0 are assigned to the combined ribbon 26. In this case, the control element S0, which is assigned to the combined ribbon 26, is preferably embodied as an assembly for use in adjusting the rotational angle position of the cross-cutter 13 in relation to a current target angular position, which correlates with the position of the forme cylinder 03. Alternatively, the control element S0 is embodied as a device that is usable for adjusting the combined ribbon position in its longitudinal direction. This can be a suitable transmission or helical toothing that can be moved relatively axially on the drive train, or, especially if the drive is mechanically independent from the printing unit 01, it may be a correction value in a control element, which counteracts the cross-cutter 13, with one of the cut-off register errors detected on the combined ribbon 26. In the case of an independent drive via an electronic, such as, for example, via a virtual guide axis, a corresponding correction to the relative rotational angle position that corresponds to the cut-off register deviation can be applied to the target value generated from the target rotational angle position value for the guide axis. The control element S1, which is assigned to one of the two ribbons 21; 22 that will ultimately be re-assembled to form the combined ribbon 26, is embodied as a guide element S1. That guide element S1 influences the path length between the former peak of the relevant fold former 16; 17 and the point at which the ribbons 21; 22, are combined. This point may be, for example, a roller 24 or advantageously may be a roller pair 24, and especially may be a forced nipping group 24. In the present case, this control element S1 is embodied as a roller S1, such as, for example, a register roller S1, which register roller S1 is mounted so as to pivot on a lever around a pivoting axis that is parallel to the rotational axis. However, a control element S1, such as, for example, a register roller S1, which is movable in another manner, for example linearly, can also be provided. The control element S1 can be adjusted by a drive, which is not specifically shown in FIG. 3, using an assigned controller that corresponds to a signal from the control loop R1. Alternatively, this signal can be advantageously applied to the control element listed below S2; S3*a*; S3*b*; S4*a*; S4*b*; S5. As is shown in FIG. 3, in the embodiment in which a control loop R1, having only one detector D1 that is directed toward one of the two lateral surfaces or outer layers, is assigned to the ribbon 21; 22 that is to be controlled with respect to cut-off register or cut-off registers, this only one detector D1 is advantageously directed toward the side or toward the outer layer which is in direct contact with the surface of the partially wrapped roller that is directly upstream, for example the control element S1. In the discussion which follows, this side of the ribbon 21; 22 is also called the "inner side." This nomenclature also applies to other examples.

Figure 4:
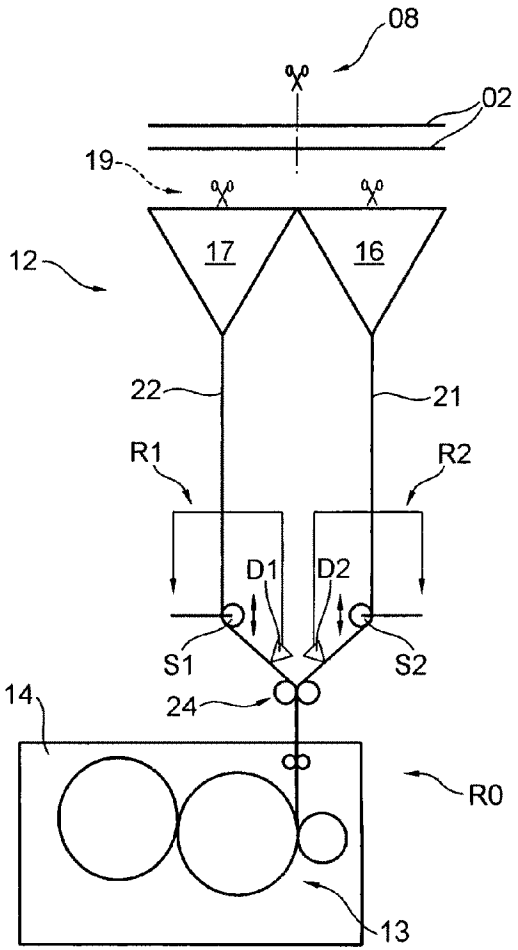
FIG. 4 a side elevation view of a second preferred embodiment of a cut-off register controller in a former assembly.

In another embodiment of the present invention, as depicted in FIG. 4, rather than the control loop R0 being assigned to the main ribbon 26, a control loop R1; R2 with detector D1; D2 and control element S1; S2, and especially with control elements provided as register roller S1; S2, is assigned to each of the ribbons coming from one of the fold formers 16; 17; 18. In this embodiment, by shifting both control elements S1; S2, the position of the combined ribbon 26 can be corrected in relation to the position of the blade of the cross-cutting device 13. By shifting only one of the two control elements S1; S2 or by shifting the two control elements S1; S2 differently, a relative position of the ribbons 21; 22 with respect to each other can be corrected.

Figure 6:
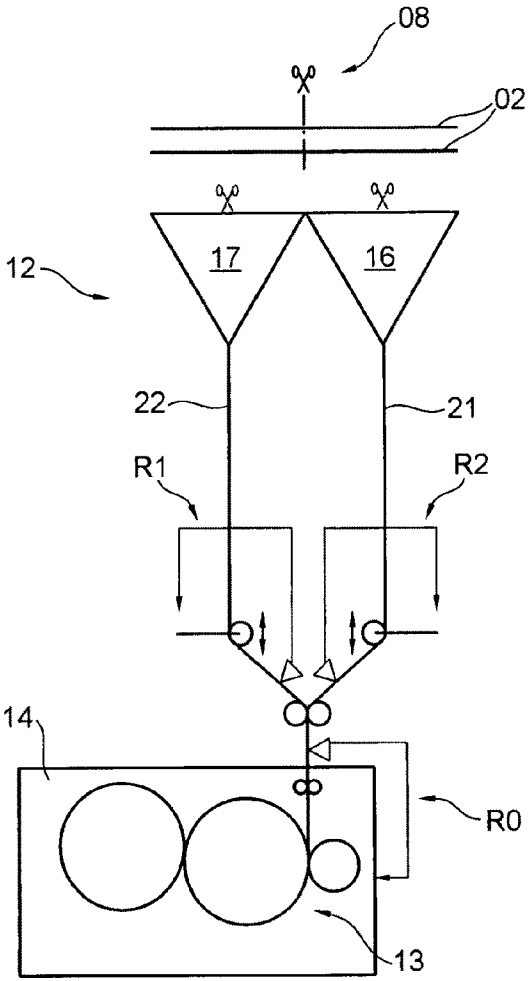
FIG. 6 a side elevation view of a fourth preferred embodiment of a cut-off register controller in a former assembly.

FIG. 6 shows another embodiment of the present invention in which each of the two ribbons 21; 22, as depicted in FIG. 4, is assigned a control loop R1, R2, and the combined ribbon 26 is assigned its own control loop R0. In this embodiment, when the position of the combined ribbon 26 is incorrect, it can be corrected via the control loop R0. Unnecessary, and/or unnecessarily large adjustment paths for the ribbons 21, 22 or of the assigned control loops R1; R2 can be avoided in this arrangement.

Figure 5:
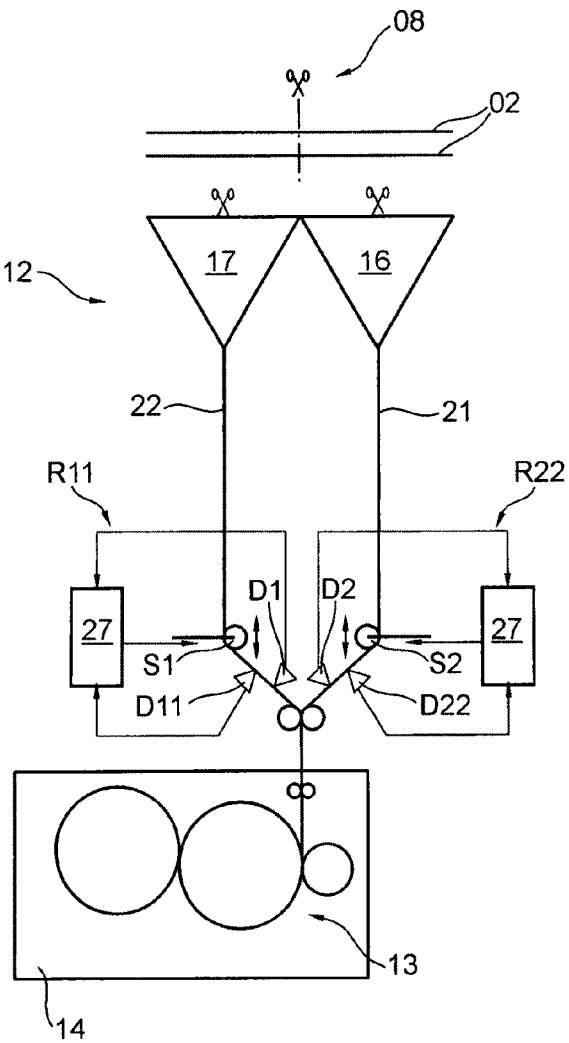
FIG. 5 a side elevation view of a third preferred embodiment of a cut-off register controller in a former assembly, with measurement on both sides of the ribbon.

In one advantageous embodiment of the control loops R1; R2 R3, etc., these control loops, or some of these control loops, as is shown in FIG. 5 by way of example for control loop R1 and R2 which are labeled in FIG. 5 as R11 and R22, are each embodied with two detectors D1; D11; D2; D22. In other words, each control loop R11 and R12 is embodied with one detector D11; D22 for each outer layer or side of the respective ribbon 21; 22 and with one detector D1; D2 for each inside layer of the respective ribbon 21; 22. The two outer layers of the respective ribbon 21; 22 are thus monitored by detectors D11 and D22. This allows greater precision in identifying errors. The position of the ribbon 21; 22, which has a certain thickness, is monitored in an evaluation device 27, for example via averaging or via some other mathematical process, such as, for example, by a, weighted mean, and from the result, a corresponding control signal is sent to the control element S1; S2, as needed.

In another application of the present invention or in a further improvement on the aforementioned application, this detector arrangement, for use in monitoring both sides of each ribbon, also monitors the ribbon 21; 22 for bump or bubble formation. Both sides of each ribbon 21; 22 are checked for conformance to the preset pattern for the correct position. If the two sides deviate to differing degrees from the pattern, or if only one side deviates, such as, for example, in the case of a shifted relative phase angle, there will be a difference in the deviation. When this difference reaches a certain level, a reaction is triggered. This reaction may involve merely the display of a warning, or an adjustment value, such as, for example, the lead of a roller may be changed.

Figure 7:
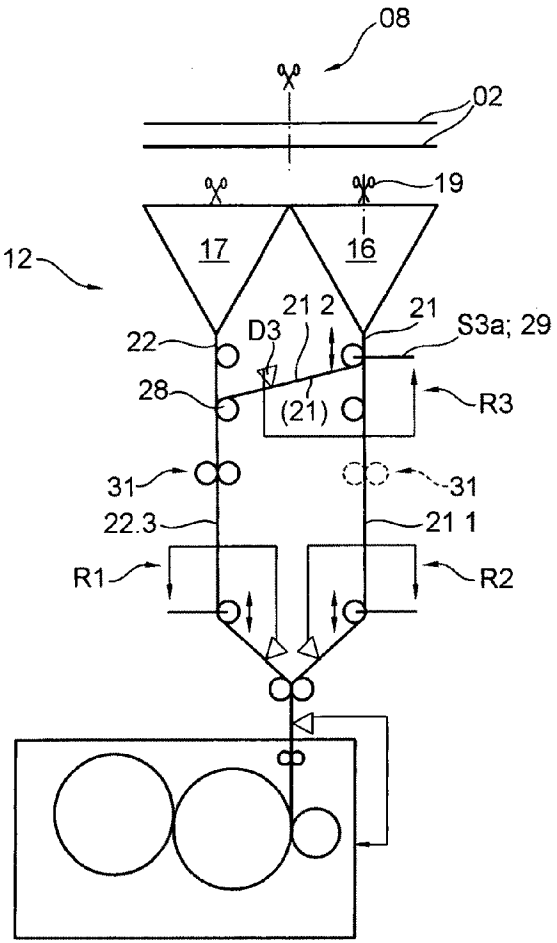
FIG. 7 a side elevation view of a fifth preferred embodiment of a cut-off register controller in a former assembly with a crossover of a partial ribbon.

In one advantageous embodiment of the former assembly 12, in accordance with the present invention, that former assembly is embodied with crossover devices 28; 29, such as, for example, with rollers 28; 29 for ribbon splitting and/or for ribbon combining, as may be seen in FIG. 7. In this embodiment and assuming a former center cut for the webs 02 of the ribbons 21; 22 to be divided, ribbons 21, 22 or partial ribbons 21.1; 21.2; 21.3; 22.1; 22.2; 22.3 from different fold formers 16; 17 18 may be split and/or may be combined. This may be beneficial in order, for example, to achieve a variable "book configuration," such as, for example, an increased variability in the number of layers and/or sequence and/or allocation without additional turns. In this case, a stitcher 31, which is represented schematically only in FIG. 7 by way of example, may be provided in one or more of the ribbon paths. A partial ribbon 21.1; 22.1, which is coming from a fold former 16; 17; 18, can be guided through this stitcher, together with the ribbon 22; 21 or the partial ribbon 22.2; 21.1 coming from the other fold former 17; 16; 18.

Figure 12:
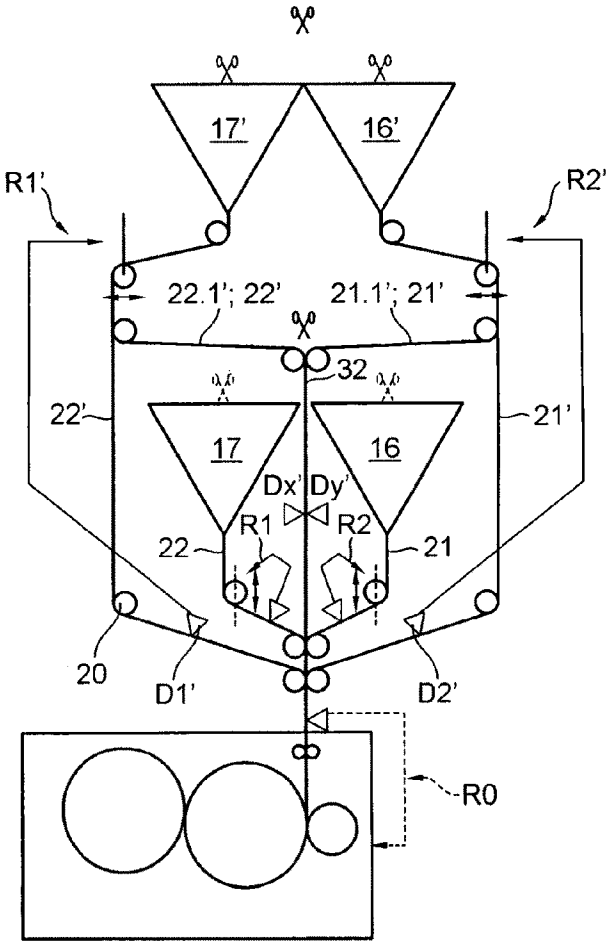
FIG. 12 a side elevation view of a tenth preferred embodiment of a cut-off register controller in a former assembly with two former planes.
Figure 11:
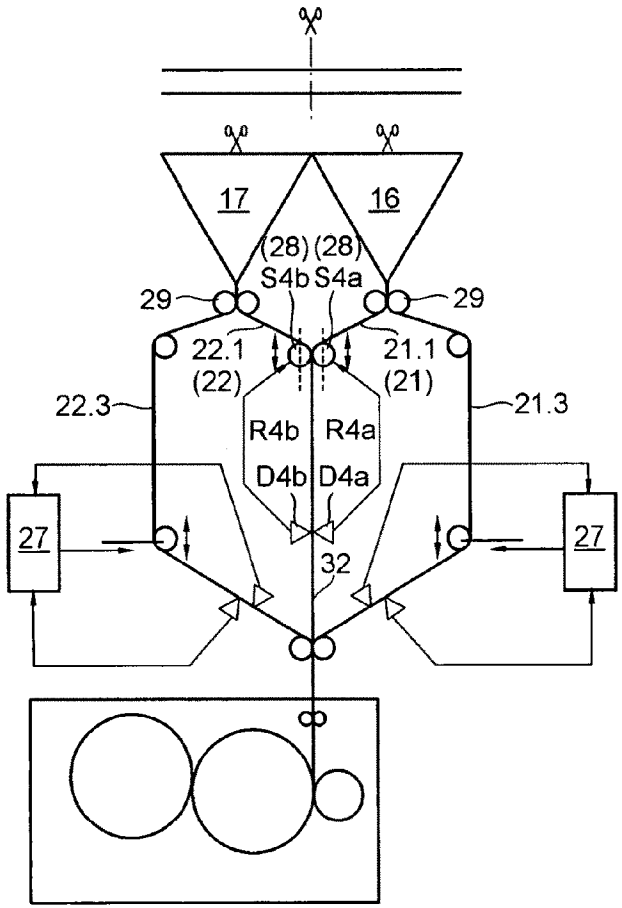
FIG. 11 a side elevation view of a ninth preferred embodiment of a cut-off register controller in a former assembly, with crossover of two partial ribbons.

The arrangement of one or more stitchers 31 in one or more ribbon paths, such as, for example, a stitcher 31 in the ribbon path of the ribbon 22 to which the partial ribbon 21.2 has been added, and/or a stitcher 31 in the ribbon path of the ribbon 21.1 from which the partial ribbon 21.2 has been removed, and/or a stitcher 31 in a ribbon path of a ribbon 32 formed from partial ribbons 21.1; 22.1 from two fold formers 16; 17; 18 as may be seen, for example in FIG. 11, or FIG. 12, is not explicitly mentioned or represented in each of these variants in the following examples. However this arrangement should be correspondingly applied to all of the embodiments that are advantageous in terms of product configuration.

In FIG. 7 through 11, preferred embodiments of the present invention and showing the option of ribbon splitting and/or of ribbon combination are provided. In a respectively alternative operation, the crossed over ribbon 21.2 of the example depicted in FIG. 7 can also be a full crossed over ribbon 21 (22), as indicated by the term in parentheses (21).

Figure 8:
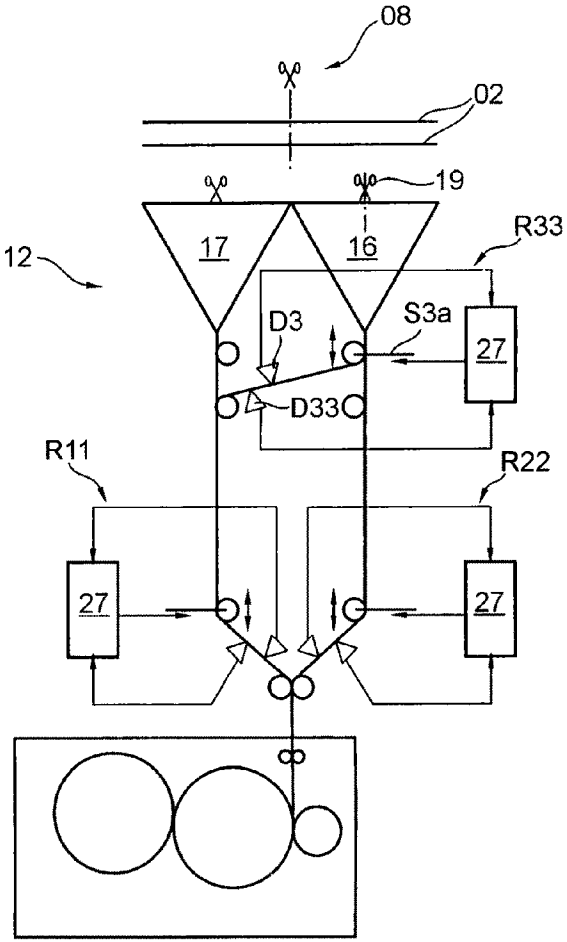
FIG. 8 a side elevation view of a sixth preferred embodiment of a cut-off register controller in a former assembly with a crossover of a partial ribbon and with measurement on both sides.

In FIGS. 7 and 8, in addition to the two control loops R1; R2 and R11; R22 respectively, which are assigned to the ribbon paths of the ribbons 21; 22, a separate control loop R3 or R33 can be assigned to the uncoupled partial ribbon 21.2. Statements made with regard to the "single-sided" and "double-sided" control loops R1; R2 and R11; R22 in FIGS. 4 and 5, respectively, apply correspondingly to the separate control loop R3 or R33. In the embodiment of the present invention, for use in splitting and/or combining the partial web or webs, at least two crossover devices 28; 29, which may be embodied for example, as rollers 28; 29, are provided below the fold formers 16; 17. Over one crossover device, a partial web 21.2 that wraps around the roller 29, is separated from the remainder of the partial web 21.1 and is turned back over the other roller 28 and is combined with a ribbon 22 or with a partial ribbon from the other fold former 17; 16, as may be seen in FIG. 7. To check the cut-off register position of the uncoupled partial ribbon 21.2 and to correct it if necessary, the control loop R3 or R33, either as a "single-sided" or a "double-sided," control loop, as discussed above, and that is assigned to this uncoupled partial ribbon 21.2 is provided with one or two detectors D3; D33 and also with a control element S3*a*; S3*b* as depicted in FIG. 7 or in FIG. 10, respectively. In the case illustrated here, the control element S3*a*; S3*b* can correspond to the crossover roller 29, which in this case is embodied as a register roller that can be moved in the manner mentioned above. To provide a better overview, in FIG. 7 through 16, not all repeated components in the figures are identified by reference symbols. However, these components can be identified at any time.

Figure 10:
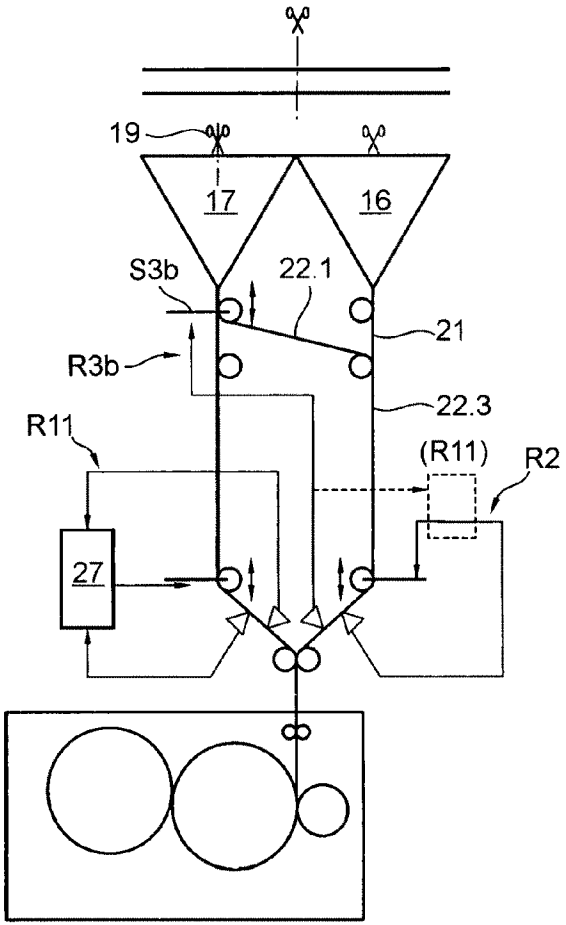
FIG. 10 a side elevation view of an eighth preferred embodiment of a cut-off register controller in a former assembly with a crossover of a partial ribbon.
Figure 9:
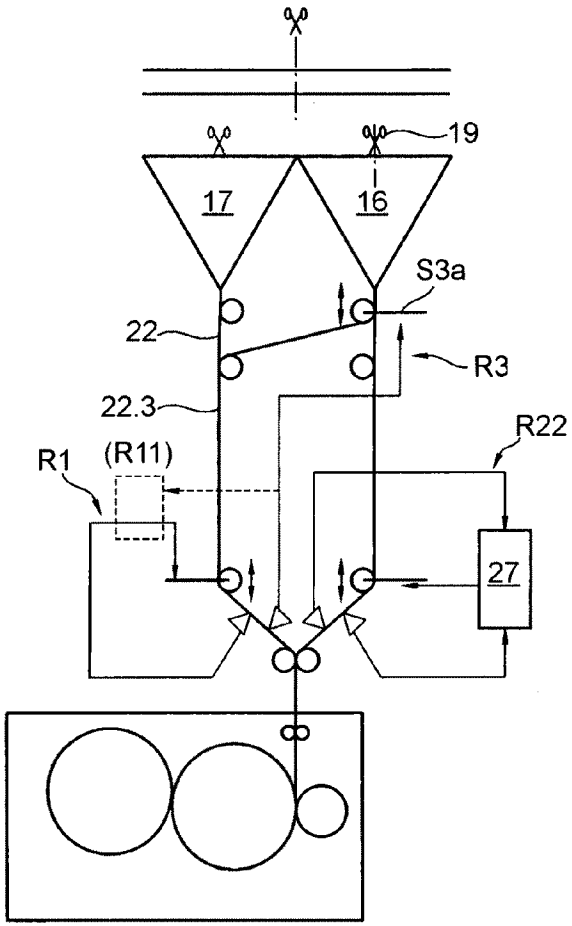
FIG. 9 a side elevation view of a seventh preferred embodiment of a cut-off register controller in a former assembly with a crossover.

FIG. 9 shows a variation of the preferred embodiments of FIGS. 7 and 8 in which no detector is allocated to the control loop R3; R33 of the uncoupled partial ribbon 21.2 on the crossover path. Instead, the side of the ribbon 22.3 that is created from the partial ribbon 21.2 is detected only after this partial ribbon 21.2 has been added to the partial web 22. A detector, such as detector D1 of a previously two-sided control loop R11, which is directed toward the inner side of the resultant ribbon 22.3 that is formed, can be used for this, as shown in FIG. 9. In the variation which is represented by dashed lines in FIG. 9, the signal from the inner detector D1 of a two-sided control loop R11 can be fed both to the control loop of the uncoupled partial ribbon 21.1 and to the two-sided control loop R11 of the ribbon 22. In the arrangement which is depicted in FIG. 10, the circumstances of FIG. 9 are represented, by way of example, for the uncoupling of a partial ribbon 22.1 from the ribbon 22 of the other fold former 17; 16. The examples of FIGS. 7 and 8 can generally each be applied to the opposite case.

FIG. 11 shows a further embodiment of the present invention and with crossover devices 28; 29. In each of these cases, a partial ribbon 21.1; 22.1 is uncoupled via rollers 29, and the two partial ribbons will be, or are merged via rollers 28 to form a ribbon 32. The remaining or residual ribbons 21.3 and 22.3 are controlled in accordance with FIG. 3, 4 or 5. Control loops R4*a* and R4*b*, each with one respective control element S4*a* and S4*b*, and each with at least one respective detector D4*a* and D4*b*, are assigned respectively to the two uncoupled partial ribbons 21.1 and 22.1. If the crossover devices 29 were to be configured again to function simultaneously as control elements, as described and as depicted in FIG. 7, the detectors D4*a* and D4*b* would be located on the crossover paths. In the embodiment which is shown in FIG. 11, however, the crossover devices 28 function simultaneously as control elements S4*a* and S4*b*. The detectors D4*a* and D4*b* are therefore situated on both sides of the resultant ribbon 32 that is formed using the partial ribbons 21.1 and 22.1. Depending upon production requirements, a stitcher can again be advantageously provided on each of the paths of the three ribbons 21.3; 22.3 and 32 that are produced, or on the path of only the center ribbon 32, or on one of the two ribbons 21.3; 22.3 in addition to the center, or only on the two remaining ribbons 21.3; 22.3. Such a stitcher or stitchers is/are not specifically depicted in FIG. 11 but are so depicted in FIG. 7, for example.

FIG. 12 shows a preferred embodiment of the former assembly 12 with two former planes, each having multiple fold formers 16, 17, 16'; 17', in this case with each plane having two such formers 16, 17, 16', 17', arranged side by side, and with the two former planes being offset from one another vertically. Previous discussions relating to the ribbons 21 and 22 and to the various embodiments of the configuration and arrangement of control loops R0; R1; R2; R11; R22 for "normal operation," without merging and/or splitting, are applicable individually to the ribbon paths for ribbons 21; 22 and 21'; 22' of the two former planes of each one of the former plane, as discussed in accordance with the preceding embodiments. In addition to the embodiments involving undivided ribbon paths, as have been described above, one or more of the upper ribbons 21' and 22' can be turned as an entire ribbon and can then be fed between the lower fold formers 16; 17 18. For the ribbons 21; 22 of the two lower fold formers 16; 17, in one advantageous embodiment, which is not specifically shown in FIG. 12, the configurations involving the uncoupling of partial ribbons 21.1; 22.1 can be applied correspondingly to the examples of FIG. 7 through 10 with the corresponding use of crossover devices, which crossover devices are also not specifically shown. The same applies to the ribbons 21' and 22' of the upper former group. In this case, and depending upon the arrangement of the control elements which act upon the partial ribbons 21.1; 22.1; 21.1'; 22.1', the detectors which are directed toward the partial ribbons 21.1; 22.1; 21.1'; 22.1' are arranged as in the above-described embodiment. If one of the upper ribbons 21'; 22' is run between the lower fold formers 16; 17 rather than outside them, as is depicted in FIG. 12, a detector Dx' or Dy', which is or are arranged on the path running between the formers, is assigned to each relevant control loop R1'; R2', respectively. When an upper ribbon 21'; 22' is divided, these detectors Dx' or Dy' can also be used for the corresponding control loop R3*a*'; R3*b*'; R4*a*'; R4*b*'. Although FIG. 12 depicts only "single-sided" control loops, the previously set forth discussions relating to double-sided control loops can be applied accordingly. The control loop R0, which is indicated by dashed lines in FIG. 12, can optionally be provided in addition to, or in place of one of the ribbon-based control loops. In this regard, see FIG. 3 through FIG. 6 accordingly.

In FIG. 13, the previous description of preferred embodiments of the present invention, that have two fold formers 16' 17 or 16'; 17' arranged side by side, is here represented, by way of example, in a former group having three fold formers 16; 17; 18 arranged side by side, and with double-sided control loops R0 R11; R22; R55. The embodiments of the present invention, which were presented above, should be applied accordingly to the variation of the present invention involving single-sided control loops, which are not specifically shown here, and/or the embodiment with an assembly for ribbon division or for ribbon splitting and/or for the positioning of one or more stitchers and/or for the positioning of two former planes, each having three fold formers.

FIG. 14 shows a further variation of a preferred embodiment of the present invention, and with three fold formers 16; 17; 18 arranged side by side in a single former plane. In addition to the roller 24 or to the roller pair 24, a roller 33 or a roller pair 33, and especially a nip roller pair 33, is provided, by the use of which roller or roller pair 33 two of the three ribbons 21; 22; 23 can be combined before being united downstream with the third ribbon 22. A stitcher 31 can be provided in the ribbon path after the point at which the two ribbons 21; 23 are merged, as depicted in dashed lines in FIG. 14. In principle, as an alternative or in addition to this, a stitcher 31 may also be arranged in the ribbon path of the third ribbon 22, as is also depicted in dashed lines. The above discussions, with regard to configuration of single-sided or double-sided control loops and/or the embodiment involving devices for ribbon division or ribbon splitting and/or with regard to the positioning of one or more stitchers and/or with regard to the positioning of two former planes, each with three fold formers, apply accordingly to the above-represented embodiments.

In the various represented examples of the present invention, the cross-cutter 13 represents a part of the folding unit 14 which is located downstream of the former assembly 12, and is comprised of a transport cylinder 38, which cooperates with a blade cylinder 37 and a folding jaw cylinder 39 to form a cross fold. The cross-cutter can also be differently configured, however, and can be embodied without or with a folding unit downstream.

The control loops which have been discussed generally above, and in what follows, are preferably based upon the following mode of operation.

Based upon the geometric distance between the respective detector D0 . . . D55 and the site of cross-cutting, which typically is the cross-cutter 13 of the folding unit 14, the phase of a point of print, which repeats based upon the printing length, and/or the phase of a feature to be detected on the web, and/or the phase of the ribbon in stationary or steady-state operation are in a fixed relationship with one another. The target phase position, which can be determined, for example, through geometric evaluation or empirically, such as, for example, during a start-up of the machine, or during a production test run, is thus characterized in that, in this special target phase position between the detected feature, or a pattern, and a cyclical pulse of the cross-cutting device, the cut is made downstream, at the desired location on the web or the ribbon. During stationary or steady-state operation, and/or without the various influences on the paper as print substrate during the printing process and/or the various properties of different types of paper, it would therefore be sufficient, in a specific production process with specific ribbon guides, to simply adjust the control elements correspondingly, without requiring control.

Under varying operating conditions, however, such as, for example, with varying dampness and/or with varying ink quantities, varying transport speed, varying paper types, and the like, the paper stretch varies. Therefore, the position of the desired cut line to be formed by the cross-cutter 13, and based upon a specific path segment, varies. The result is that the relative phase position between the detected feature or pattern and the cycle of the cross-cutter 13 varies. The relevant control loop R0-R55 is then embodied such that the deviation of the actual phase position from the target phase position is registered. The assigned control element is then acted upon so as to counteract the deviation in the phase position.

Former assemblies having multiple fold formers and optionally also having multiple former planes result in long ribbon paths, with some of those long ribbon paths having multiple turns. These long ribbon paths must ultimately all be aligned correctly with one another and with the cross-cutting device during assembly of the resultant printed product. Different ribbon paths may also be subject to different variations. In order to meet the strict requirements in such multiple former systems under non-stationary or non-steady state conditions, and without creating large amounts of wasted paper, especially during press start-up, the control loops as presented in the above described preferred embodiments are provided. Ideally, the detectors D0-D55 that monitor the ribbons are located as far downstream as possible in the ribbon path. In other words, these detectors D0-D55 are located as close as possible to the blade of the cross-cutter 13.

The previously described control loops R0 . . . R55 are preferably based upon optical measurement methods. The detectors D0 . . . D55 are preferably embodied as optical detection devices, which are directed toward the respective ribbon surfaces and which detect the light that is reflected off of these respective ribbon surfaces.

In one simple embodiment in accordance with the present invention, each detector D0 . . . D55 has a measuring head with a light-sensitive sensor, such as, for example, one of more photodiodes, also called a cut-off register sensor. A supplementary source of illumination may be provided. The light-sensitive part of the measuring head is directed toward the surface of the ribbon, for example through a suitable lens system. It is capable of scanning a point or an area of small diameter, thereby scanning a strip of greater or lesser width on the passing ribbon. The allocated electronic evaluation system can continuously record the light/dark pattern created by the printed image, for example. This recorded pattern is then compared with the pattern of the target phase position. The phase position, or a "snapshot" for the phase position of a periodically repeating pattern, such as, for example, a mark, which may be applied specifically for this measurement, and which is periodically repeating, or a light/dark pattern from the periodically repeating printed image, or for certain features of this pattern, is then compared with the target phase position of the pattern or the corresponding feature of the pattern. If a deviation of the actual or measured phase pattern from the desired relative phase position is detected, this deviation is counteracted as described above through the utilization of the relevant control loop with the control element.

If the measuring head is embodied with multiple sensor areas which can each be read out independently of one another, such as, for example, with a local resolution option, a snapshot which is triggered by the clock cycle of the cross-cutter and which is compared in the evaluation unit of the controller with the pattern of the target phase position may also be advantageous. The multiple sensor areas of the measuring head are then preferably embodied as photodiodes, for example.

In the above-described, simpler embodiment of the sensors D0 . . . D55, which scan the print image or the pattern and/or a mark "in points," in one advantageous embodiment, the sensor is arranged so as to be movable crosswise to the direction of ribbon travel. Because only a narrow strip of the passing printed image is scanned, it is advantageous to be able to adjust the detector D0 . . . D55 in accordance with the position of the marks or in accordance with the position of a suitable printed image strip. This is particularly beneficial, for example, in production processes that involve varying web widths and therefore varying partial ribbon widths and/or for use with different printed images.

A more convenient embodiment of the detector D0 . . . D55 is embodied as an image sensor, such as, for example, as a CCD chip or a CMOS chip. The detector D0 . . . D55 can preferably have a line camera or a surface camera as its sensor. The detector D0 . . . D55, which may be embodied, for example, as an image sensor or at least as a line camera, can be embodied as a sensor which detects the printed image over at least a significant scanning width. The term "significant scanning width" in this case is understood to mean a width amounting to at least one-fourth the maximum ribbon width that can be produced in the machine and in the former assembly, for example. In a further improved embodiment, the scanning width corresponds to at least one-half of this ribbon width and covers half the ribbon width from the ribbon center outward, for example. This allows the detector D0 . . . D55 to be stationary in a simple embodiment in accordance with the present invention.

The pattern to be scanned, such as a mark or a printed image section, and/or the target phase position of this pattern can advantageously result from data, and especially from image data, from the pre-press run. In particular, it can be advantageous to establish the position of a strip to be detected, in relation to a direction that extends crosswise to the direction of ribbon travel, and in the case of a laterally movable detector, to align that detector correspondingly. In connection with the inspection of an image area by a surface camera or a line camera, the printed image section which is to be inspected can also be identified in the pre-press run, either crosswise or longitudinally. In the pre-press stage, the spacing of the characteristic patterns, up to the cut-off edge, which are provided for evaluation are known. These patterns can therefore be used to generate the target phase position and/or for accomplishment of the lateral alignment of the detector D0 . . . D55.

Figure 18:
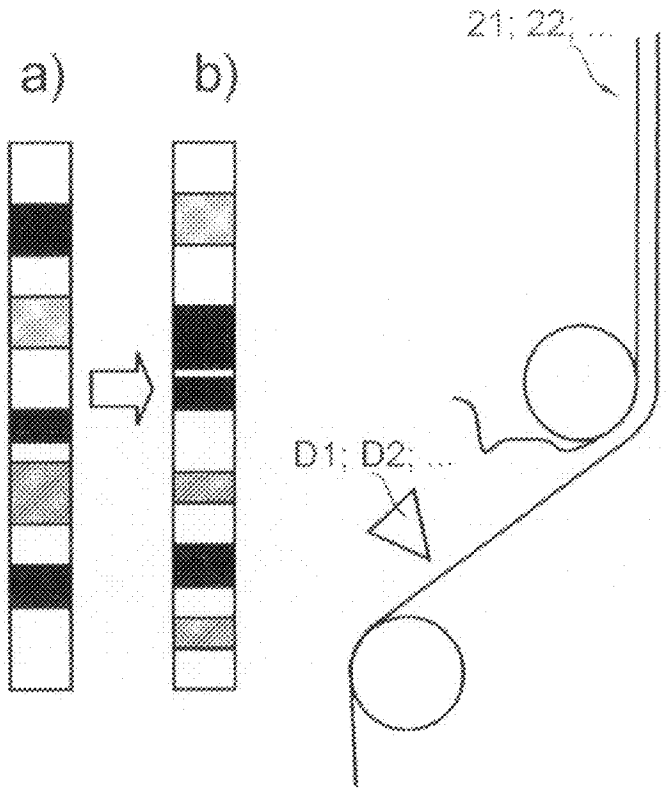
FIG. 18 a representation of the measuring technique depicted in FIG. 17 and with a broken outer layer.

In an embodiment of the present invention, which is advantageous in connection with the preceding embodiments of FIGS. 2 through 14, but which is also advantageous when viewed alone, at least one ribbon 21; 22, but preferably each ribbon 21; 22, coming from a fold former 16; 17 18, has a detector D1; D2 and an evaluation device 34 on at least one side, and especially at least on the "inner side," which is at particular risk for web break of a single layer. Such an arrangement can be seen, for example, in FIGS. 15 and 16. The evaluation device 34 in this embodiment is embodied to compare a periodically repeating pattern, or at least to compare a periodically repeating features of this pattern, which is recorded by the detector D1; D2, with a previously recorded and/or stored pattern, or features of this previously recorded pattern. The evaluation device 34 is equipped with corresponding storage and/or computing capabilities for this purpose. If the currently recorded pattern deviates dramatically, typically beyond certain permissible limits, from the previously recorded and/or stored pattern, a break in the outer layer of the ribbon 21; 22, which is being inspected, can be deduced. FIG. 17 shows a schematic illustration of a track which is measured by the detector D1; D2 as a light/dark pattern. If a break occurs in this outer layer upstream of the detector D1, D2, the detector will suddenly see a pattern that is completely different from the previously detected pattern. This is represented in FIG. 18 by the two schematically illustrated light/dark patterns. If there is no break in the outer layer, the detector D1; D2 will read the respective track as a light/dark pattern. In the case of tabloid production, such as, for example, with ribbons 21; 22 having partial webs that are cut apart in the area of the secondary cut lines, if a break occurs in the outer layer, and especially on the "inner side", potentially resulting in a partial web wrap-around, the corresponding measuring head will read the pattern of the partial web layer underneath this outer partial web layer located on the "inner side".

Figure 15:
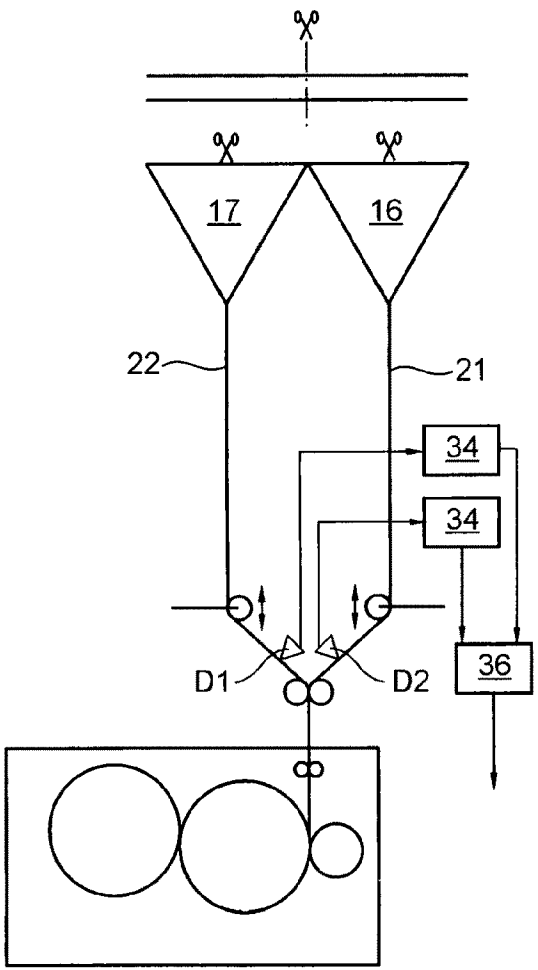
FIG. 15 a preferred embodiment of a web break detection system.

If one of the evaluation devices 34 diagnoses a web break, this result can be reported via an output interface 36 as depicted in FIG. 15. Such an output interface 36 can be provided on a display and/or on a message device in the printing press, for example, and especially can be displayed on the control panel. A control engineering measure can be automatically triggered directly. For example, the machine can be stopped and/or the element at risk can be shut off by the use of a relevant controller.

Figure 16:
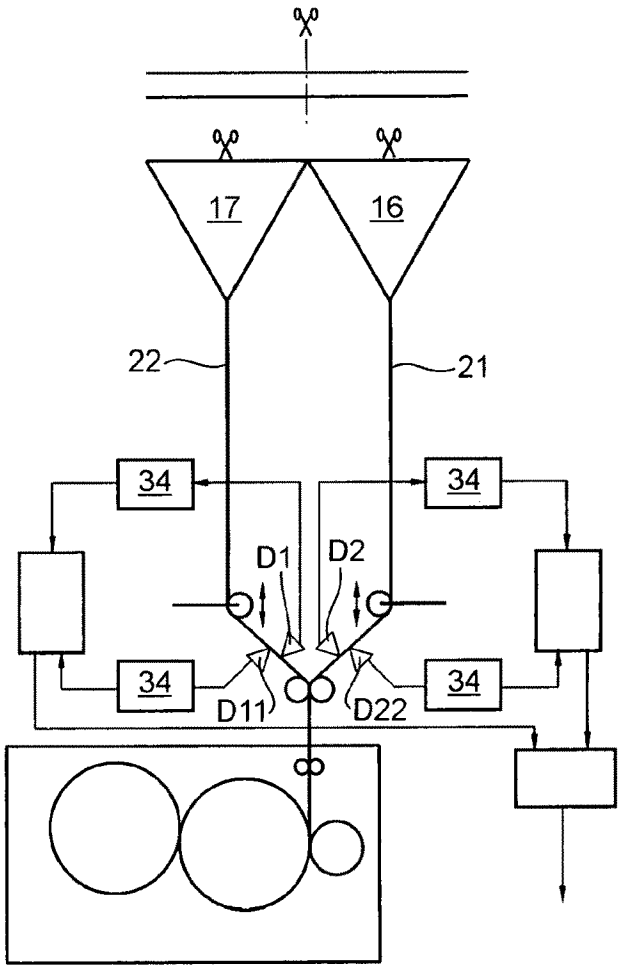
FIG. 16 another preferred embodiment of a web break detection system.
Figure 17:
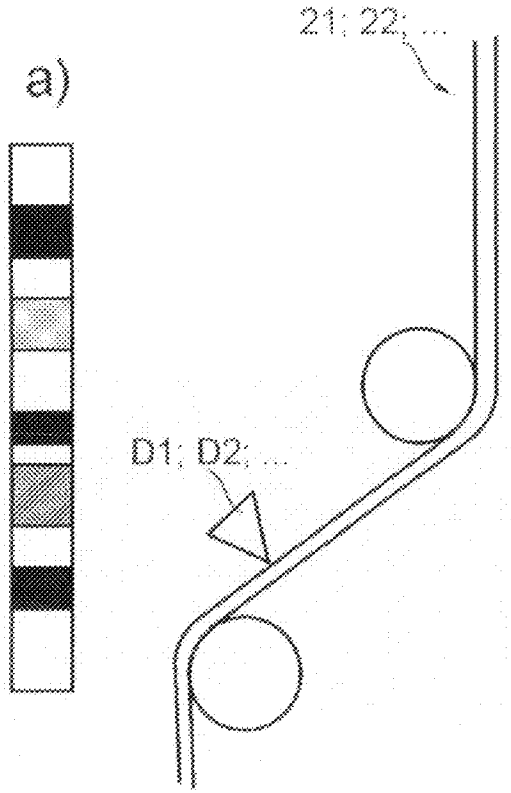
FIG. 17 a schematic representation of the measuring technique used in the web break detection system in accordance with the present invention.

FIG. 16 shows an embodiment corresponding to that of FIG. 15. The difference is that in the FIG. 16 embodiment, the ribbon 21; 22 is measured and is evaluated on both sides.

If the embodiments depicted in FIGS. 15 through 18 for detecting breaks in individual layers will be used in combination with one or more embodiments of the ribbon register controller of FIGS. 2 through 14, it is advantageous for the same detectors D1 . . . D55 or for their signals to be used for each ribbon for the evaluation of register control and for the evaluation of a possible break. In this case, the evaluation units 34 can optionally be integrated into the relevant evaluation units of the assigned control loops.

While preferred embodiments of cut-off register controllers in a former assembly and methods of controlling cut-off register, in accordance with the present invention, have been set forth fully and completely hereinabove, it will be apparent to one of skill in the art that various changes in, for example, the types of printing press units used to print the webs, the specific structures of the fold formers and of the cross-cutter and the folding unit, could be made without departing from the true spirit and scope of the present invention which is accordingly to be limited only by the following claims.

What is claimed is:

1. A cut-off register controller in a former assembly of a web-fed rotary printing press comprising:

a first number of longitudinal fold formers in said former assembly, said first number of longitudinal fold formers being disposed side-by-side on a first former plane;

a folding unit located after, in a direction of web travel, said former assembly;

a web travel path from each of said first number of longitudinal fold formers to said folding unit;

a roller pair located at, in the direction of web travel along the web travel path, an output of said former assembly, at least one of ribbons and partial ribbons coming from each of said first number of longitudinal fold formers along each said web travel path being combined over said roller pair to form a combined ribbon;

a second number of control loops, each of said second number of control loops being adapted to control a cut-off register of one of said ribbons and partial ribbons coming from said first number of longitudinal fold formers, each of said second number of control loops being located downstream, in said direction of web travel, said fold formers and before said roller pair, said second number of control loops corresponding at least to said first number of said fold formers in said former assembly;

at least one detector in each one of said second number of control loops; and at least one control element in each one of said second number of control loops, each said control element influencing one of a path length and a relative position between said at least one of ribbons and partial ribbons between each said fold former and said roller pair.

2. The cut-off register controller of claim 1 further including at least one guide element in said web travel path intermediate said former assembly and said roller pair, said at least one detector in said web travel path being located intermediate said guide element and said roller pair.

3. The cut-off register controller of claim 1 further including at least one guide element in said web travel path intermediate said former assembly and said roller pair, each said detector in each said control loop being located between said guide element and said roller pair.

4. The cut-off register controller of claim 1 including a longitudinal cutter in one of said longitudinal fold formers in said former assembly and usable to cut at least one partial ribbon longitudinally into first and second partial ribbon segments and further including a cross-over path having a cross-over path length, said cross-over path being usable to direct one of said first and second partial ribbon segments into combination with one of a ribbon and a partial ribbon from another of said first number of longitudinal fold formers in said former assembly and further including one of said control elements in said cross-over path and being usable to control said cross-over path length.

5. The cut-off register controller of claim 4 wherein said one of said control element in said cross-over path includes one of said detectors.

6. The cut-off register controller of claim 5 further including a point of merger of said one of said first and second partial ribbons segments and said one of said ribbons and partial ribbons from said another one of said number of fold formers and wherein said one of said detectors is located after, in said direction of web travel, said point of merger.

7. The cut-off register controller of claim 1 wherein said roller pair is a last point of assembly of all of said ones of said ribbons and partial ribbons from said output of said former assembly and further wherein said detectors are located before, in said direction of web travel, said last point of assembly.

8. The cut-off register controller of claim 1 further including an evaluation unit configured to compare periodically recurring features of a sample pattern recorded by said detectors and generated by said rotary printing press with one of previously recorded features and stored features of a previously recorded pattern.

9. The cut-off register controller of claim 1 wherein there are three of said fold formers in said first former plane and further wherein there are at least three of said control loops.

10. The cut-off register controller of claim 1 including a second former plane having at least one of said fold formers and further including at least three of said control loops in said first and second former planes.

11. A method for controlling cut-off register in a former assembly of a web-fed rotary printing press including:

providing a first number of longitudinal fold formers in a former assembly;

arranging said first number of longitudinal fold formers in said former assembly side-by-side on a first former plane and forming said folder assembly having a former assembly output;

locating a roller pair at, in a direction of web travel, said former assembly output;

combining ones of ribbons and partial ribbons from said longitudinal fold formers at said roller pair and forming a resulting combined ribbon;

providing a second number of control loops after, in said direction of web travel, said first number of longitudinal fold formers and before said roller pair, said second number of control loops being at least as great as said first number of longitudinal fold formers;

providing at least one detector in each of said control loops;

using each of said detectors for sensing cut-off register of said ones of said ribbons and partial ribbons;

providing a path length controller in each said control loop, said number of path length controllers corresponding to said first number of longitudinal fold formers; and using said number of path length controllers and controlling said cut-off register of said ones of said ribbons and partial ribbons in response to said sensed cut-off register provided by each said detector to each said path length controller in each said control loop.

12. The method of claim 11 further including detecting a phrase position of a recurring pattern in one of said ribbons and partial ribbons using one of same detectors, comparing said detected phase position with one of previously recorded and stored phase positions of a previously recorded pattern and identifying a break in one of said ribbons and said partial ribbons using a result of said comparison.

* * * * *